US006431941B1

(12) United States Patent
Frawley et al.

(10) Patent No.: US 6,431,941 B1
(45) Date of Patent: Aug. 13, 2002

(54) MULTIPLE COMPONENT ACTIVATABLE MECHANISM AND TOYS CONTAINING SUCH MECHANISMS

(76) Inventors: Mark A. Frawley; Carol L. Frawley, both of 1029 Primrose La., Coopersburg, PA (US) 18036; P. Riley Lohr; Anita L. Lohr, both of 336 W. Kings, Coatesville, all of PA (US) 19320

( * ) Notice: Subject to any disclaimer, the term of this patent is extended or adjusted under 35 U.S.C. 154(b) by 0 days.

(21) Appl. No.: 09/454,727

(22) Filed: Dec. 4, 1999

(51) Int. Cl.[7] ..... A63H 11/00; A63H 13/00; A63H 3/20

(52) U.S. Cl. ..... 446/330; 446/336; 446/340; 446/337; 446/395; 446/368

(58) Field of Search ..... 446/297, 298, 446/301, 303, 320, 330, 333, 334, 335, 336, 337, 338, 339, 352, 368, 487, 340, 395, 391; 74/469, 523

(56) References Cited

U.S. PATENT DOCUMENTS 2,158,432 A * 5/1939 Schulenberg
2,716,840 A * 9/1955 Armstrong
3,856,119 A * 12/1974 Harrington ..... 186/69
4,207,704 A * 6/1980 Akiyama
4,244,138 A * 1/1981 Holahan et al.
4,324,065 A * 4/1982 Cooper
4,457,097 A * 7/1984 Miller et al. ..... 446/327
4,712,968 A * 12/1987 Manning ..... 446/427
5,359,977 A * 11/1994 Abbey ..... 123/337
5,393,259 A * 2/1995 Lee ..... 446/358
5,498,193 A * 3/1996 Locricchio ..... 446/361

OTHER PUBLICATIONS

Pictorial Handbook of Technical Devices, Grafstein, Chemical Publishing co., Inc. 1971 NY New York.

* cited by examiner

*Primary Examiner*—Derris H. Banks
*Assistant Examiner*—Urszula M Cegielnik
(74) *Attorney, Agent, or Firm*—Robert L. McKellar

(57) ABSTRACT

Multiple component activatable mechanism and toy animals containing such mechanisms. The mechanism that is contained in the animal works mechanically through a series of linkages that control the animal's head and lower jaw to create a forward lunge of the animal and an audible snapping noise from the jaws. In addition, the toy animals can be equipped with a sound module to provide appropriate sounds for the animal, which sound module can be activated anywhere along the linkage of the activatable mechanism.

5 Claims, 3 Drawing Sheets

MULTIPLE COMPONENT ACTIVATABLE MECHANISM AND TOYS CONTAINING SUCH MECHANISMS

The invention disclosed and discussed herein deals with multiple component activatable mechanisms and toy animals containing such mechanisms. The mechanism that is contained in the animal works mechanically through a series of linkages that control the animal's head and lower jaw to create a forward lunge of the head and an audible noise from the snapping of the jaws.

The inventors herein are not aware of any mechanical animal that operates in a manner the same as or similar to that disclosed herein.

THE INVENTION

One embodiment of the invention disclosed and discussed herein deals with multiple component activatable mechanisms capable of extension of the animal head, and a consequent snap motion which comprises in interconnected combination a spring retained drive bar, a pin and slot second class fulcrum, a spring retained activator bar and, a trigger bar.

A second embodiment of the invention is a toy animal containing the activatable mechanism described just above, wherein the toy animal comprises in combination a head portion comprising an upperjaw and a moveable lower jaw. There is a cowling movably joined to the head portion to form a neck portion.

There is a body having essentially two matching halves each having a central portion and a back end portion with a tail portion unitarily joined therewith. The tail portion is a continuation of the body.

Throughout the head, cowling, and body are support stanchions to support the activatable mechanisms and fasteners which are used to connect the two matching halves together to form the body, connect the body to the cowling, to connect the cowling to the head portion, and connect the moveable lower jaw to the head portion such that the cowling, head, and moveable lower jaw are capable of limited movement.

With more specificity, in the latter embodiment, the toy animal comprises in combination a head having a back, wherein the head contains a moveable lower jaw having a top and a bottom.

There is a neck formed from a moveable cowling and a body comprised of two, essentially matching halves, forming a central portion with a bottom and tail portion.

There is contained in the activatable toy animal a multiple component, activatable mechanism which comprises in an interconnected combination a spring retained drive bar, a pin and slot second class fulcrum, a spring retained activator bar and, a trigger bar, wherein the drive bar has a distal end, a near end, and a central portion wherein the distal end of the drive bar is anchored near the bottom of the moveable lower jaw and the near end is free-moving and terminates in the near end in an upwardly pointing hook. The drive bar has a retainer spring with a near end and a distal end wherein the near end is attached in an opening in the central portion of the drive bar and the distal end is attached near the top of the moveable lower jaw.

The pin and slot second class fulcrum has a near end and a distal end, the near end is anchored to the back of the head such that the pin and slot second class fulcrum has a partial rotational movement capability.

The spring retained activator bar has a near end, a distal end and a center portion, the spring retained activator bar near end being link-hinged to the distal end of the pin and slot second class fulcrum. The spring retained activator bar is attached at the center portion to a second retainer spring by one end and the opposite end of the second retainer spring is anchored to the bottom of the central portion of the body.

The trigger bar has a near end and a distal end. The trigger bar is link-hinged at its near end to the distal end of the spring retained activator bar. The distal end of the trigger bar protrudes from the bottom of the central portion of the body. The tail portion is attached unitarily to the back of the central portion and is essentially a continuation of the central portion of the body. The activatable mechanism being supported by support stanchions within the activatable toy animal configuration.

The lower jaw, fulcrum, cowling and body halves are fastened together by a fastening means such as pins and posts.

DETAILED DESCRIPTION OF THE DRAWINGS

Figure 1:
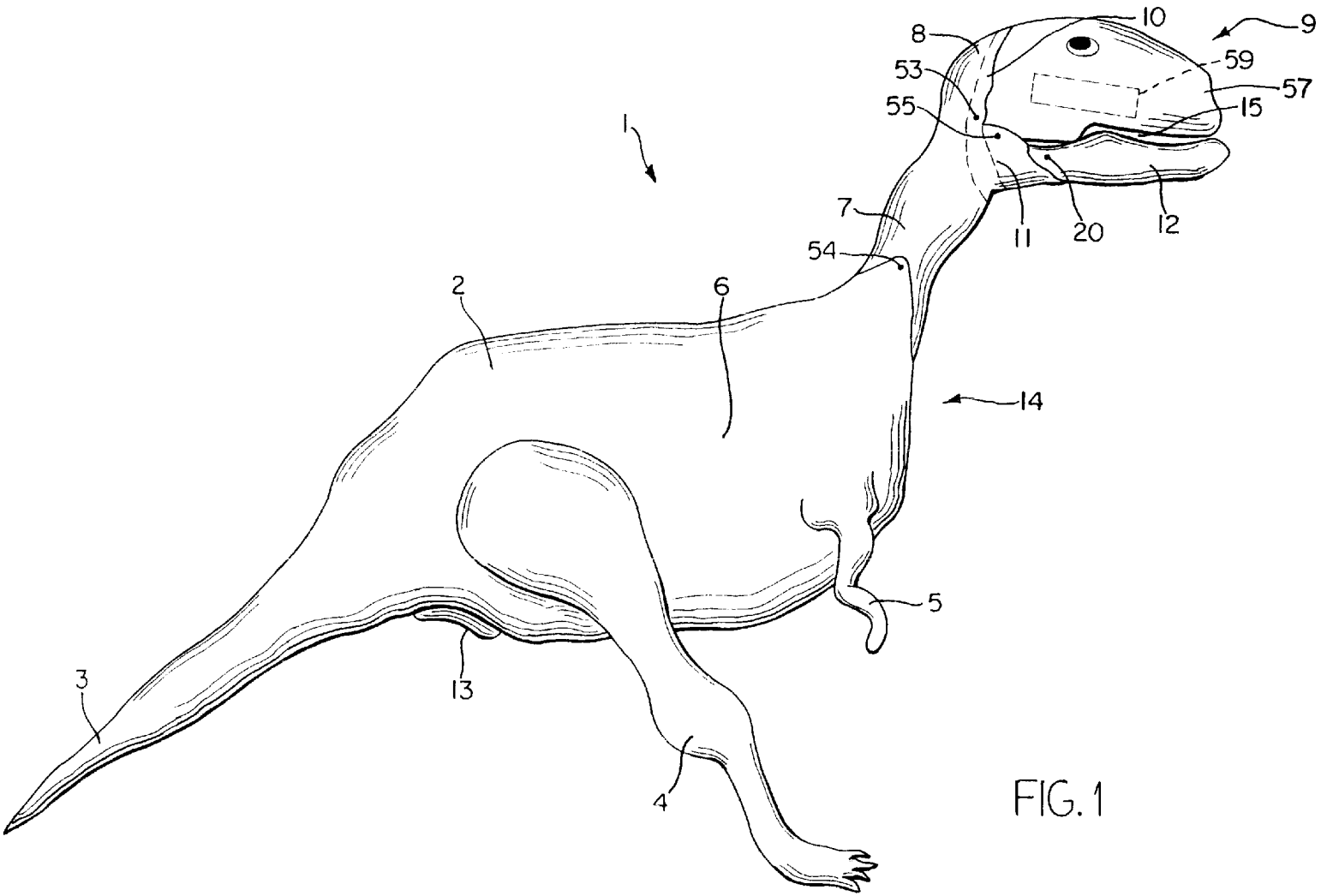
FIG. 1 is a full side view of a toy of this invention in the configuration of a dinosaur.

Turning now to FIG. 1 wherein there is shown a toy 1 of this invention in the configuration of a dinosaur. The toy 1 is comprised of several parts for purposes of easy assembly and to enhance the movement of certain portions of the toy 1 as will be described infra.

Figure 2:
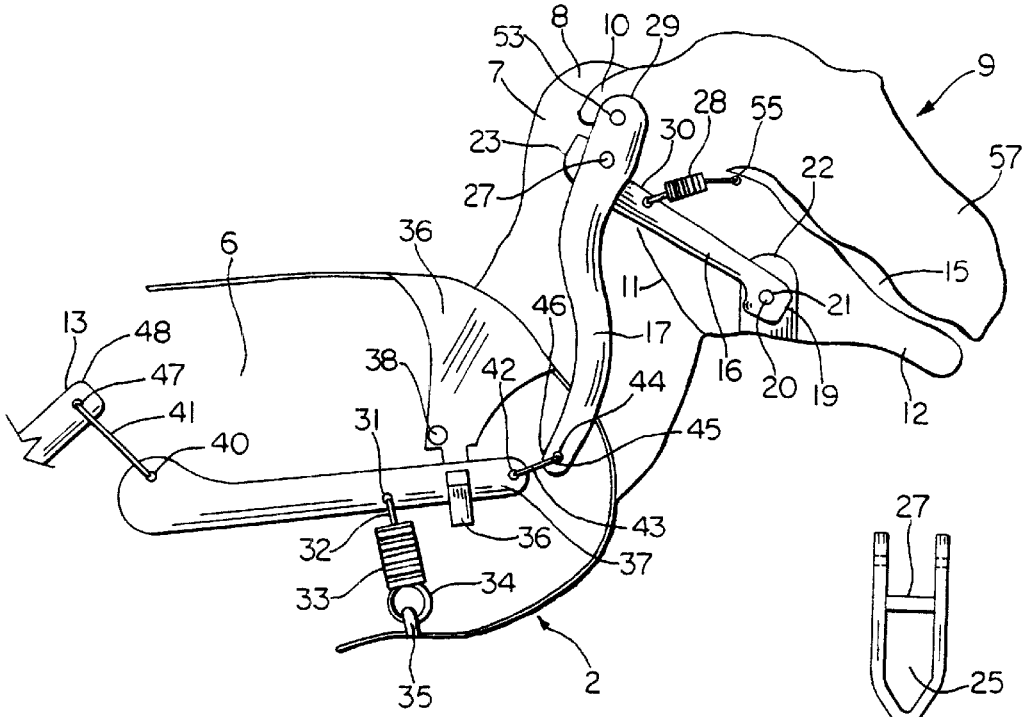
FIG. 2 is a front portion of the toy of FIG. 1 with one half of the body, neck and head removed to show the internal parts.
Figure 4:
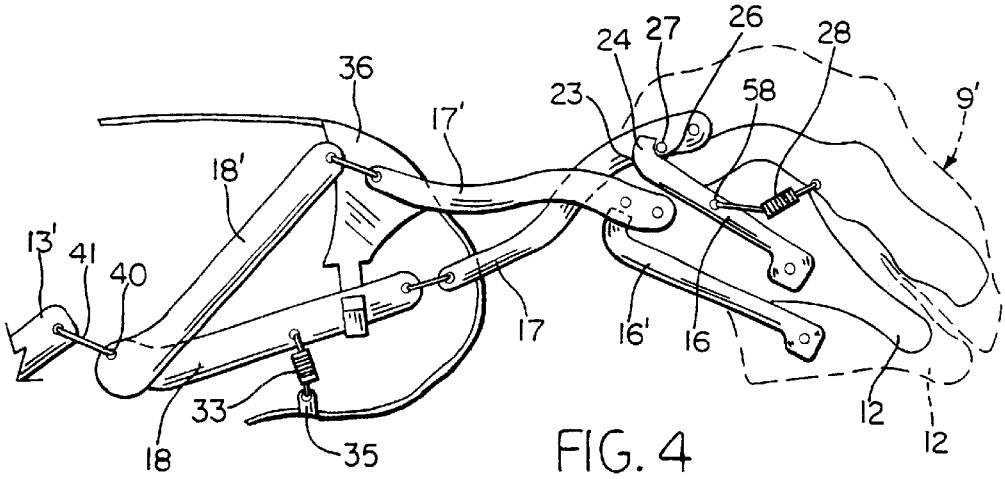
FIG. 4 is a front portion of the toy of FIG. 1 with one half of the body, neck and head removed to show the internal parts and to enable those having skill in the art to compare the position of the various parts from the rest mode to the active mode.
Figure 5:
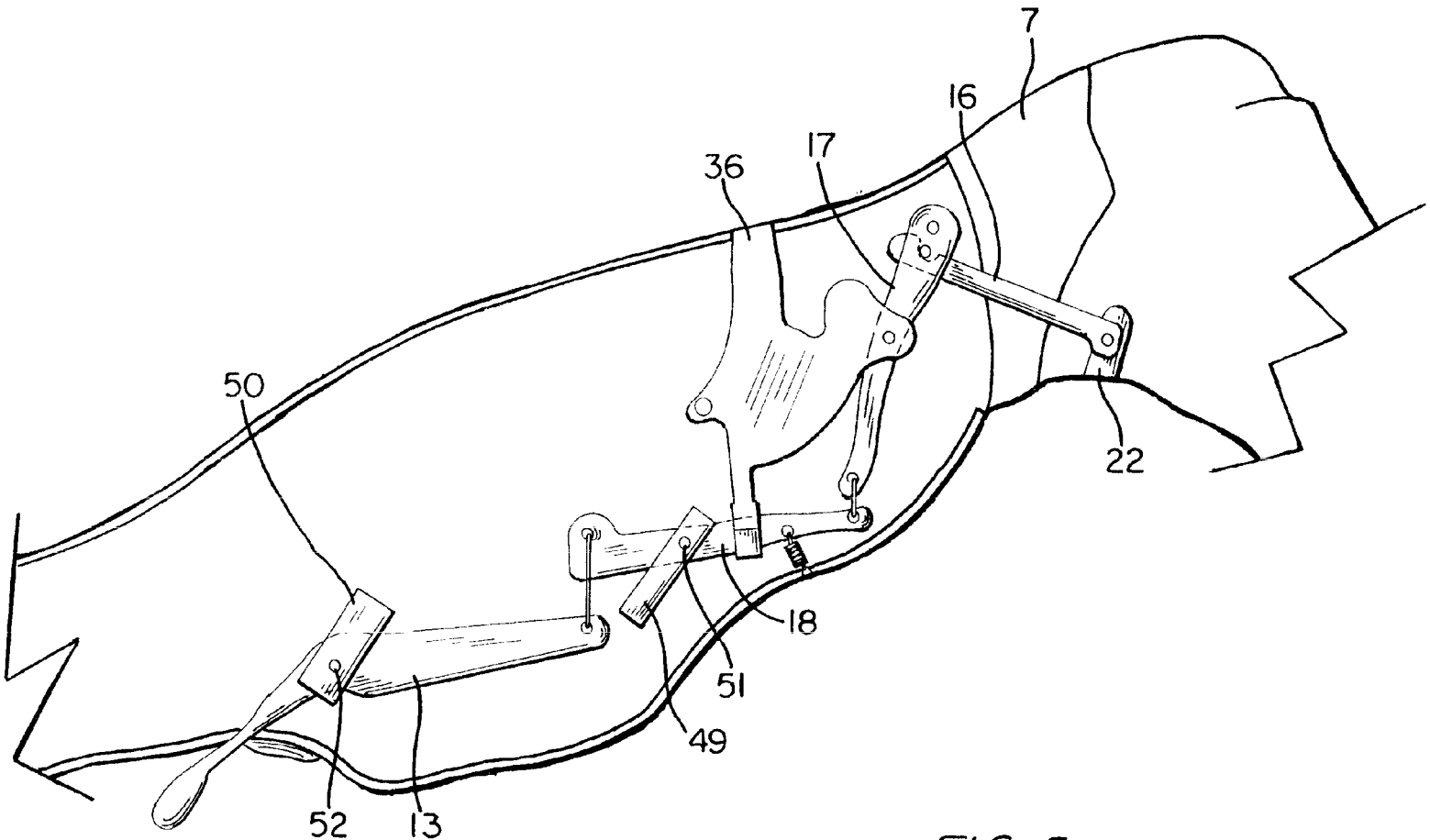
FIG. 5 is a view of one half of essentially the body portion to show the entire mechanism in the rest mode.

There is, for example, a body 2 which is a unitary structure and which is configured of two matching halves, the halves being shown in FIGS. 2, 4, and 5. There is also shown a continuation of the body 2 to terminate in a tail 3. Hind legs 4 and forelegs 5 are shown in one of the many forms of such appendages and are not a critical part of this invention. The body 2 has a central portion 6, the importance of which will become apparent in the discussion infra.

In addition to the body 2, there is a cowling 7, which essentially forms the neck of the toy 1. The cowling 7 is configured such that it has partial movement with regard to a forward and backward motion of the head 9. The top 8 of the cowling 7 form fits over the back 10 (back line shown in phantom) of the head 9 and the back 11 of the lower jaw 12. Generally, for purposes of this invention, the forelegs 5 and the hind legs 4 are preferably stationary.

Finally, there is shown a portion of the trigger bar 13, the significance of which will be described infra.

Turning now to a detailed description of the multiple component, activatable mechanism useful in this invention, reference is made to FIG. 2, which is a partial segment of the front 14 of the toy 1, including a portion of the cowling 7 and the head 9, along with the lower jaw 12. The segment shown in FIG. 2 is not a cross-sectional view, as the toy 1 is just simply split into its two matching halves, and the view is one of the back one-half containing the mechanism supported therein for purposes of discussion.

Upon operation of the mechanism, the head 9 lunges forward and the moveable lower jaw 12 opens simultaneously to give the appearance that the mouth 15 fully opens. During the forward lunging motion, the lower jaw 12 gradually opens until it reaches the end of the lunge at which point the mouth 15 closes with an audible snap. Release of the trigger 13 of the mechanism allows certain parts of the animal to return to a resting position which is with the head 9 upright, and the mouth 15 closed. The linkages (set forth below) within the mechanism are configured such that they work in a manner that coordinates and times the movement of the lower jaw 12 and mouth 15 to open slowly, coinciding with the forward lunge.

With regard to the mechanism, there is shown a portion of the trigger bar 13 (a full view can be observed in FIG. 5), a spring retained drive bar 16, a pin and slot second class fulcrum 17, and a spring retained activator bar 18 all in rest position.

As can be observed, the trigger bar 13, the spring retained drive bar 16, the pin and slot second class fulcrum 17 and the spring retained activator bar 18 are all linked together. The distal end 19 of the spring retained drive bar 16 is anchored into the base of the lower jaw 12 by the use of a pin 20 (see FIG. 1), which allows the spring retained drive bar 16 to partially rotate around the pin 20 during movement of the mechanism. It should be understood that the pin 20 is supported on both ends by support means within the lower jaw 12 and that the pin 20 is inserted through a first support means (not shown), passing through an opening 21 in the distal end 19 of the spring retained drive bar 16 and into a second support means 22, also shown in FIG. 5.

The second part of the mechanism is the pin and slot second class fulcrum 17, wherein "pin and slot" and "second class fulcrum" having the meanings set forth in "PICTORIAL HANDBOOK OF TECHNICAL DEVICES", Paul Grafstein and Otto Schwarz, Chemical Publishing Co., Inc. New York, 1971, pages 16 and 17 (pin and slot), pages 42 and 43 (second class fulcrum). It is noted that the pin and slot arrangement disclosed by Grafstein, et al, is a coupling, however, for purposes of this invention, the inter-related parts are not connected as a coupling which will be discussed infra.

The second class fulcrum shown in Grafstein, et al is described as one in which the weight is between the fulcrum and the force. Thus, with reference to the inter-relationship of the spring retained drive bar 16 and the pin and slot second class fulcrum 17, the near end 23 of the spring retained drive bar 16 has an upwardly extending hook configuration 24 (see FIG. 4), which inserts through the slot 25 (see FIG. 3). In the resting mode, the inside 26 of the hook 24 rests against the pin 27 and the hook 24 is retained against the pin 27 by the pressure exerted by the spring 28 of the spring retained drive bar 16. This arrangement is the "weight" of the second class fulcrum.

Figure 3:
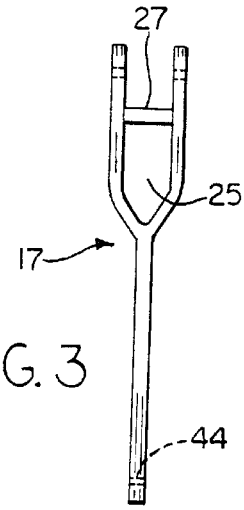
FIG. 3 is an end view of the pin and slot second class fulcrum of the mechanism.

Referring to FIG. 3, there is shown an end view of the pin and slot second class fulcrum 17. The pin is shown as 27 and the "slot" is shown as 25.

In operation, as the trigger 13 is pulled, and the other parts of the mechanism activate, the near end of the spring retained drive bar 16 moves downwardly and forward such that at the end of the downward movement, the hook 24 releases from the pin 27 and drops away with an audible snapping sound created by the jaws coming together. The "fulcrum" of the mechanism is created by anchoring the near end 29 of the pin and slot second class fulcrum 17 to the back 10 of the head 9 using pin 53. The spring 28 is attached in an opening 56 in the central portion 30 of the spring retained drive bar 16 and the other end of the spring 28 is anchored in the top of the lower jaw 12 at point 55.

The spring retained activator bar 18 is anchored to the central portion 6 of the body 2 adjacent to an opening 31 and at the same location, one end 32 of the spring 33 of the spring retained activator bar 18 is also anchored by inserting the end 32 of the spring 33 in the opening 31 . The opposite end 34 of the spring 33 is anchored to an anchor point 35 within the body 2 of the toy 1. A support stanchion 36, which has been molded into, or glued into the inside of the body 2 further supports the spring retained activator bar 18 by providing a hook 36 on which the near end 37 of the spring retained activator bar 18 rests while the mechanism is in a rest position. The hook 36 also prevents the near end 37 from dropping too low in the configuration and reversing the link hinge effect of link hinge 43. Also shown in FIG. 2, near the center of the toy 1 is a small, circular cavity 38, which is the element that receives a pin, not shown, from the other half of the toy 1, in order to join the two halves together and assemble the toy 1. Pin 55 in FIG. 1 is a pin used to attach the lower jaw 12 to the upper jaw 57 of the head 9. This attachment allows for a partial rotation of the lower jaw 12 around the pin 55.

The spring retained activator bar 18 has an opening 42 in its near end 37, into which a link-hinge 43 is placed and attached. The opposite end 45 of the link-hinge 43 is hooked into an opening 44, in the distal end 46 of the pin and slot second class fulcrum 17.

The opposite end 39 of the spring retained activator bar 18 has an opening 40 in it to which a wire link hinge 41 is attached. The wire link hinge 41 freely floats in the opening 40 and the opposite end 47 of the link-hinge 41 is hooked into the near end 48 of the trigger bar 13.

Now with reference to FIG. 5, there is shown a full side view of a representation of the mechanism in the rest position, including the trigger bar 13. In addition, there is shown support stanchions 49 and 50, which support the spring retained activator bar 18 and the trigger bar 13, respectively. The support stanchions 49 and 50 can be molded into the inside of the body 2, or can be glued in place, depending on the mode of manufacturing that is desired. It should be noted that each of the stanchions 49 and 50 have their respective bars pinned at or near the center of the bar by pins, respectively, 51 and 52, and it should be further noted, that pins 53 and 54 are used to attach the cowling 7 to the back of the head 10, and the bottom of the cowling 7 to the body 2, respectively.

The entire mechanism is activated by pulling the distal end 58 of the trigger bar 13 in an upward and backward (toward the body 2) motion which causes the near end 48 of the trigger bar 13 to depress. The depression of the near end 48 draws down the link hinge 41 which in turn depresses the distal end 39 of the spring retained activator bar 18. This movement in turn causes the near end 39 of the bar 18 to raise, which in turn causes the distal end 46 of the pin and slot second class fulcrum 17 to raise. Upon this raising movement, near end 29 of the pin and slot second class fulcrum rotates around pin 27 until the spring retained drive bar 16 releases from the pin 27 to create an audible snap created by the lower jaw 12 impacting the upper jaw 57. At the same time, the mechanism extends the head forward, and the jaws open in a menacing manner. The "at rest" position is shown in FIG. 2. The "activated" position and the "just before snap" positionare shown in FIG. 4, wherein the major active mechanism parts are denominated as 13, 18, 17, and 16, to show the active position and the equivalent parts in the "just prior to snap" position are denominated as 13', 18', 17', and 16'. Also in FIG. 4, the head 9 in the "just prior to snapping" position is shown in phantom and the head in the active position is shown as 9'. At the end of the forward extension, when the trigger bar 13 is released, the retention springs 28 and 33 return the mechanism to a resting position. The trigger bar 13 can be activated slow or fast and this determines the intensity of the forward lunge and the audible snap of the jaw.

Also contemplated within the scope of this invention is a talking animal. Partially and repeatedly pulling the trigger bar 13, gives the effect that the animal is talking.

Further, it is contemplated within the scope of this invention to incorporate a means of providing sound for the talking embodiment of the invention. For this purpose, reference can be made to FIG. 1, wherein there is shown in phantom a sound module 59 which is mounted in the upper jaw 57. This sound module can be a simple sound system, either mechanical, or electrical, or electronic, and its activation can be provided at any point along the linkage. This sound module provides a growling sound, or a speaking voice, or similar effect when the animal is activated through the trigger bar 13.

What we claim is:

1. A multiple component, activatable mechanism capable of extension and snap, comprising in interconnected combination:

a spring retained drive bar;

a pin and slot second class fulcrum;

a spring retained activator bar, and a trigger bar.

2. A toy containing the mechanism of claim 1.

3. A toy as claimed in claim 2 wherein the toy is configured from the group dinosauria.

4. A toy comprising:

the activatable mechanism of claim 1 contained and supported within an animal configuration which comprises in combination:

a head portion comprising an upper jaw and a moveable lower jaw:

a cowling movably joined to the head portion to form a neck portion a body having essentially two matching halves and having a central portion having a back end and a tail portion unitarily joined with and a continuation of the body;

support stanchions for the activatable mechanism, and fasteners to connect the two matching halves together to form the body, connect the body to the cowling, to connect the cowling to the head portion, and connect the moveable lower jaw to the head portion such that the cowling, head, and moveable lower jaw are capable of movement.

5. An activatable toy animal comprising in combination:

a head having a back, said head containing a moveable lower jaw having a top and a bottom;

a neck formed from a moveable cowling;

a body comprised of two matching halves forming a central portion having a bottom, and a tail portion, and contained in the activatable toy animal:

a multiple component, activatable mechanism comprising in an interconnected combination:

a spring retained drive bar;

a pin and slot second class fulcrum;

a spring retained activator bar and, a trigger bar, wherein the drive bar has a distal end, a near end, and a central portion wherein the distal end of the drive bar is anchored near the bottom of the moveable lower jaw; the near end is free-moving and terminates in the near end in an upwardly pointing hook, and, the drive bar has a retainer spring with a near end and a distal end wherein the near end is attached in an opening in the central portion of the drive bar and the distal end is attached near the top of the moveable lower jaw;

the pin and slot second class fulcrum having a near end and a distal end, the near end being anchored to the back of the head;

the spring retained activator bar having a near end, a distal end and a center portion, said spring retained activator bar near end being link-hinged to the distal end of the pin and slot second class fulcrum, said spring retained activator bar being attached at the center portion to a second retainer spring by one end thereof, and the opposite end of the second retainer spring being anchored to the bottom of the central portion of the body;

the trigger bar having a near end and a distal end, said trigger bar being link-hinged at its near end to the distal end of the spring retained activator bar, the distal end of the trigger bar protruding from the bottom of the central portion of the body; said tail portion being attached unitarily to the back of the central portion and being essentially a continuation of the central portion;

said activatable mechanism being supported by support stanchions within the activatable toy animal configuration;

said lower jaw, fulcrum, cowling and body halves being fastened together by a fastening means.

* * * * *